United States Patent [19]

Stühn

[11] Patent Number: 4,913,283

[45] Date of Patent: Apr. 3, 1990

[54] CASE FOR DRAWING BOARDS

[75] Inventor: Karl-Hermann Stühn, Kirchen, Fed. Rep. of Germany

[73] Assignee: Koh-I-Noor Rapidograph, Inc., Bloomsbury, N.J.

[21] Appl. No.: 175,007

[22] Filed: Mar. 30, 1988

[30] Foreign Application Priority Data

Mar. 31, 1987 [DE] Fed. Rep. of Germany ..... 8704754

[51] Int. Cl.[4] ..... A45C 3/02; A45C 11/36

[52] U.S. Cl. ..... 206/224; 190/124; 190/127; 190/902

[58] Field of Search ..... 206/224; 190/900, 901, 190/902, 11, 16, 127, 107, 124

[56] References Cited

U.S. PATENT DOCUMENTS

| | | | |
|---|---|---|---|
| 965,469 | 7/1910 | Krueger | 190/127 |
| 2,159,069 | 5/1939 | Zalkind | 229/5.7 |
| 2,810,618 | 10/1957 | Larsen . | |
| 2,822,013 | 2/1958 | Renz | 190/127 |
| 2,950,792 | 8/1960 | Axtell | 190/124 |
| 3,073,057 | 1/1963 | Farber . | |
| 3,185,271 | 5/1965 | Kotkins | 190/127 |
| 3,259,217 | 7/1966 | Platt | 190/115 |
| 3,487,991 | 1/1970 | Stern . | |
| 3,941,300 | 3/1976 | Troth . | |
| 4,019,674 | 4/1977 | Ikelheimer et al. . | |
| 4,102,485 | 7/1978 | Johnsson . | |
| 4,374,555 | 2/1983 | March | 190/127 |
| 4,448,292 | 5/1984 | Comfort | 220/4 F |
| 4,470,620 | 9/1984 | Gerch | 190/11 |
| 4,475,650 | 10/1984 | Defazio, Jr. . | |
| 4,527,677 | 7/1985 | March et al. | 190/127 |
| 4,529,069 | 7/1985 | March | 190/127 |
| 4,637,544 | 1/1987 | Quercetti . | |

FOREIGN PATENT DOCUMENTS

| | | |
|---|---|---|
| 8605969 | 3/1987 | Fed. Rep. of Germany . |
| 2026427 | 2/1980 | United Kingdom . |
| 2187168 | 9/1987 | United Kingdom . |
| 2188032 | 9/1987 | United Kingdom . |

*Primary Examiner*—Stephen P. Garbe

*Attorney, Agent, or Firm*—Fitzpatrick, Cella, Harper & Scinto

[57] ABSTRACT

A moisture-proof, easily transportable case for writing or drawing boards is provided. In accordance with the invention, a case which protects the writing or drawing board during transportation from the manufacturer to the user, and also protects the contents of the case from water damage, is formed by a process which does not generate a significant amount of waste material. Corrugated plastic foil (5, 6) is inserted into opposed case side support (3, 3') that are extruded from plastic. Additionally, separating bars (8, 8') are provided on the inside of the side supports to define the space (2, 2') within which a writing or drawing board is kept.

11 Claims, 3 Drawing Sheets

CASE FOR DRAWING BOARDS

BACKGROUND OF THE INVENTION

1. Field of the Invention

The present invention relates to cases for writing, drawing and hobby tools, and specifically to a moisture-proof transport case for a writing or drawing board. This case is intended not only to protect the writing or drawing board on the way from the manufacturer to the user, but should also provide the user with a moisture-proof transport device for the writing or drawing board and the other tools required for drawing.

2. Brief Description of the Prior Art

A number of cases for writing or drawing boards are already known. Conventional cases are constructed of laminated and printed cardboard, the cardboard being cut out and provided with creases in such a way that the case can be assembled in a few steps and can be closed after a writing or drawing board has been put inside. During mass production, such a case can only be closed by means of automated devices because the corrugated cardboard easily springs back after being folded.

This particular problem is addressed by the case disclosed in German Utility Model DE-GM 86 05 969. However, production of this case has the decided disadvantage of generating a significant amount of waste material when the case is cut out, due to the number of folds. Also, this case is not waterproof, so that it is usually possible for it to become soggy during transport and therefore be destroyed. Of course, it would be possible to incorporate a waterproof material such as plastic into a case of the type disclosed in DE-GM 86 05 969. This modification would not, however, resolve the cutting or waste problems associated with the mass production of the case.

OBJECT AND SUMMARY OF THE INVENTION

It is accordingly the object of the present invention to remove the disadvantages described above, and at the same time to design a case which not only avoids creation of waste, but also makes possible the safe transport of writing or drawing boards, along with paper and drawing accessories, without the risk of damaging the contents of the case either by physical blows or by moisture.

To attain this object, a case of the type described above is embodied in accordance with the invention such that it is made possible to insert edges of a folded corrugated plastic foil or cardboard panel into side supports extruded of plastic. By means of the invention a case for writing or drawing boards is created which has a stable shape and thus permits easy storage, and further is made by a process which generates no waste because of rectangular cuts to define the panel.

Based on the design according to the invention it is also possible to make cases of different sizes with the same side supports by simply cutting larger or smaller pieces accordingly.

By means of guide ribs provided in the side supports, steady support of the inserted writing or drawing boards as well as of the corresponding accessories is attained, thus preventing damage to the boards and accessories.

An exemplary embodiment is described in detail by means of the accompanying drawings.

DESCRIPTION OF THE PREFERRED EMBODIMENT

Figure 1:
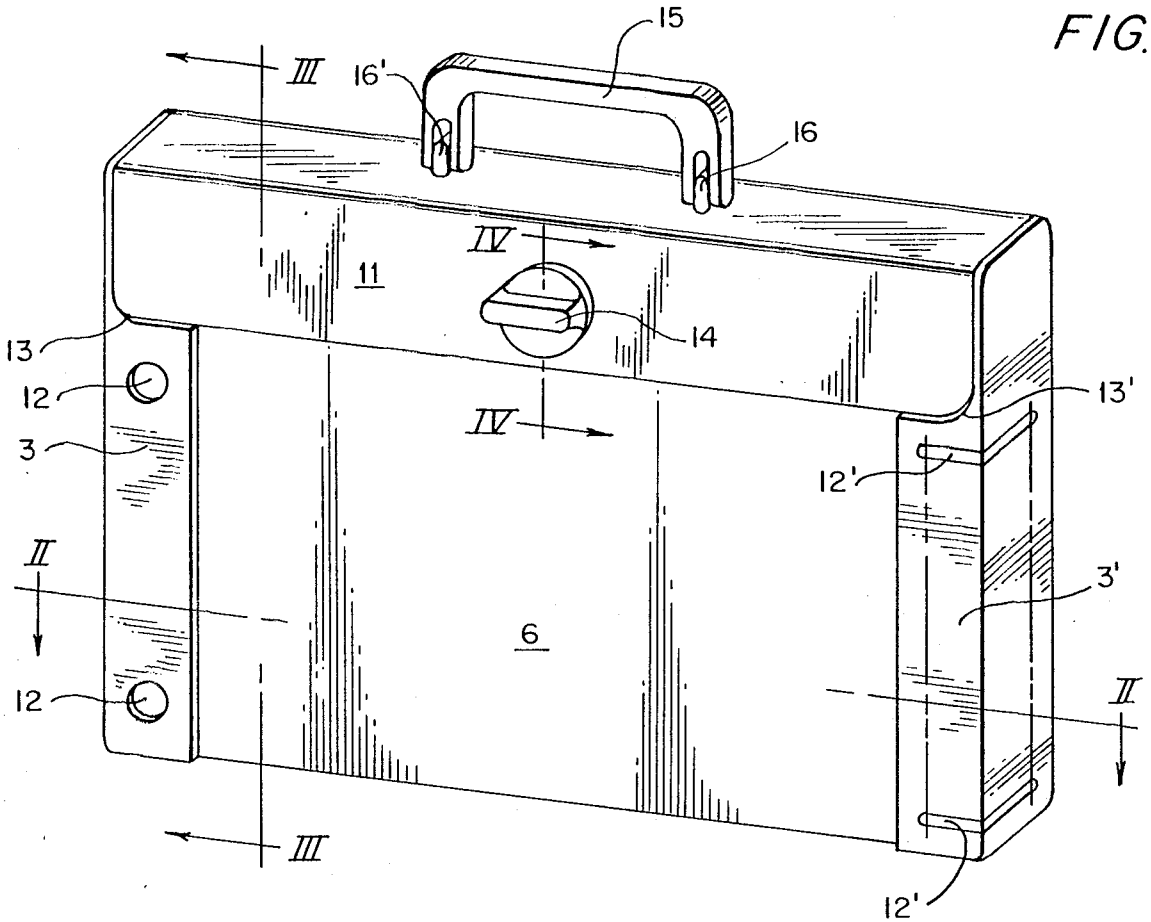
FIG. 1 is a perspective view of the novel case of the present invention.

FIG. 1 shows a perspective view of the case. Opposite edges of a corrugated plastic foil panel (5, 6) is inserted into side supports (3, 3') that are extruded from plastic. The foil sheet is preferably folded four times after cutting, the front (6) being overlapped by the lid (11).

So that the lid (11) fits snugly, the side supports have been correspondingly shaped in the region of the lid (13, 13'). The hinge parts (16, 16') for the handle (15) have been inserted through the top of the case.

The view of the side supports (3, 3') further shows that indentations (12, 12') may be incorporated into the side supports. These indentations (12, 12') can have a variety of shapes and are used as decorations; the circular shape (12) and the grooves (12') shown are only two possibilities.

Figure 4:
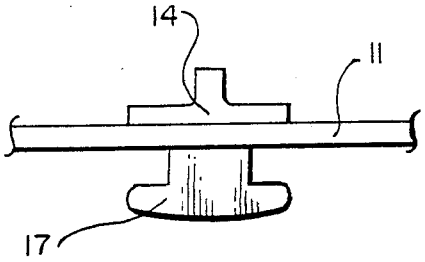
FIG. 4 is a sectional view corresponding to the line IV—IV.
Figure 5:
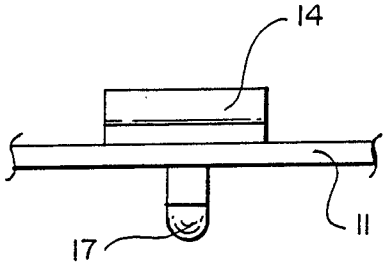
FIG. 5 is a side view of the perspective of FIG. 4.
Figure 6:
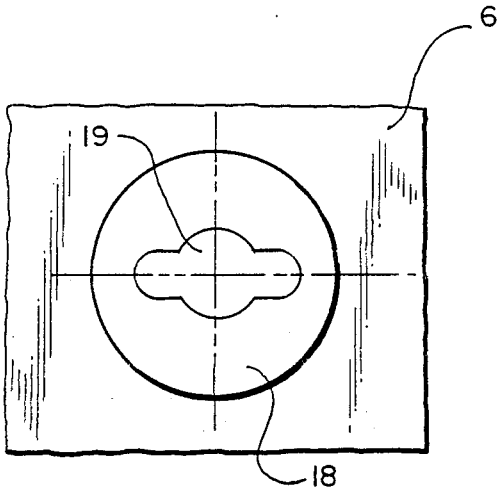
FIG. 6 is a cutout from the corrugated cardboard sheet, showing the closure plate of the closure device.

Closure elements can be incorporated into the lid (11), making for a secure connection between lid (11) and front (6). In the exemplary embodiment shown in FIG. 1, the closure element (14) consists of a toggle. Obviously, other closures are conceivable. FIGS. 4 and 5 show the arrangement of the closure device. Obviously, several closures could be used with wider cases. The closure plate (18) with the elongated slot (19) is installed in the front (6). This part may be attached to the front portion (6) of the corrugated plastic foil panel by gluing, welding, compressing, etc. Each toggle (14) has a lower end on which a closure bar (17) is formed, and can be inserted into the lid (11). When closing the case the closure bars are inserted through the elongated slot. Locking is accomplished by turning the toggle (14), preferably 90 degrees. Opening of the case is done by reversing this procedure.

Figure 2:
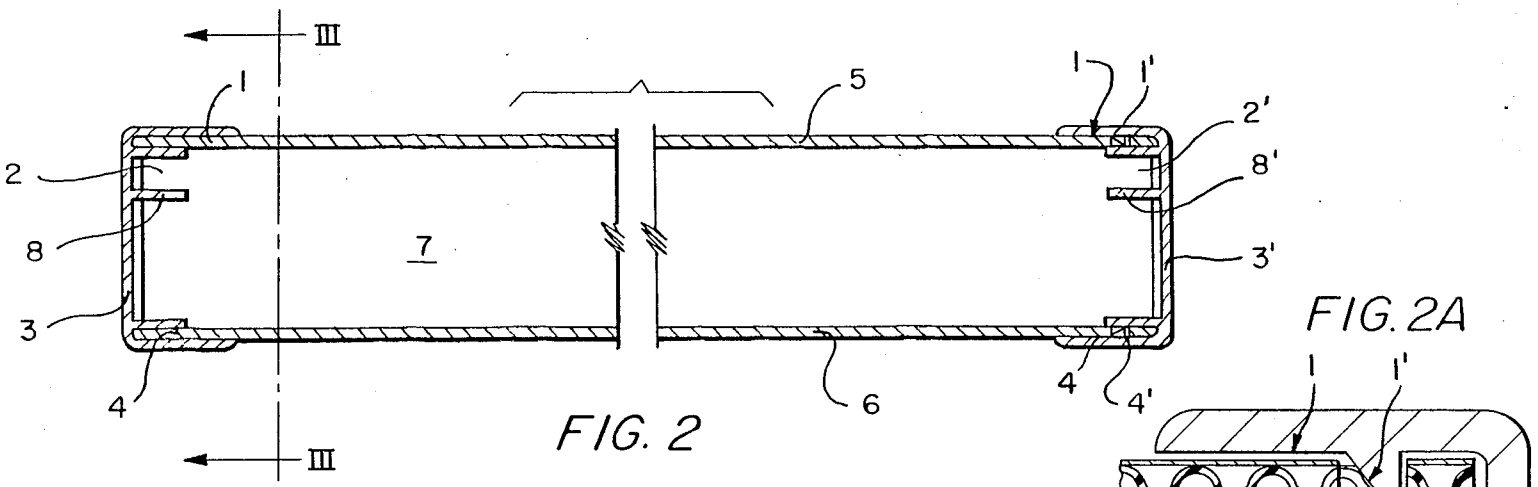
FIG. 2 is a sectional view corresponding to the line II—II.
Figure 2A:
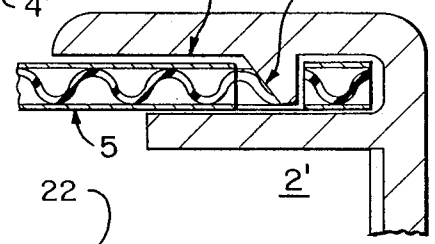
FIG. 2A is an enlarged, detail section view of the upper right corner structure of FIG. 2.
Figure 3:
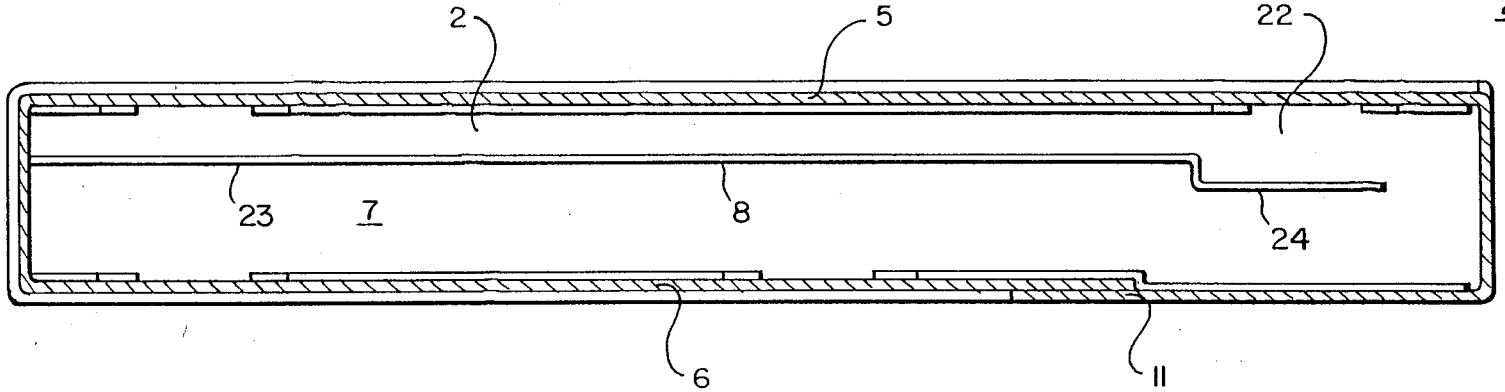
FIG. 3 is a sectional view corresponding to the line III—III.

As shown in FIGS. 2 and 3, special inserting pockets (1, 4) are formed in the side supports (3, 3'), into which edges of the corrugated plastic foil panel is inserted. As shown by the enlarged detail view of FIG. 2A, the inserting pockets (1, 4) of FIG. 2 may include barbs (1', 4) internally within the inserting pockets (1, 4), which are intended to prevent the pulling out of the corrugated plastic panel edge after insertion.

Furthermore, supporting bars (8, 8') are provided extending partially inward on the inside of each of the supports which define the space (2, 2') within which the writing or drawing board is kept. The supporting bars (8, 8'), as shown disposed extending partially inwardly from one of the plastic side supports. The lower region (23) of the supporting bar (8) is parallel to the front and rear case surfaces (5, 6) and the supporting bar also has a bent upper region (24) so as to form an upwardly open space within the case for insertion of an item that has a portion parallel to the front and rear case surfaces, and FIG. 3, are disposed in a staggered configuration in the area of insertion. The T-square of a drawing board can be stored in the wider area (22) thus created between the upper rear surface (5) and the bent upper region (24) of the support bar (8), for example.

Of course, additional supporting bars are possible besides the pair of supporting bars (8, 8') shown, for example, if several writing or drawing boards are to be carried. It is also conceivable to insert a continuous separating board in order to create a space for receiving paper and drawing tools which should not be touched by the writing or drawing board. By such means it is assured that the paper and drawing tools are not damaged when the writing or drawing board is taken out.

While a preferred embodiment of the invention has been described, the invention is to be defined by the scope of the appended claims:

I claim:

1. A case for holding writing, drawing and hobby tools, and in particular individual writing or drawing boards, of the type comprising one or more corrugated panels comprised of a plastic material to define a front surface, a rear surface, a bottom surface and a lid thereof, a handle and a pair of opposed, vertically extending side supports (3, 3') that are plastic extrusions and have insertion means for engaging with an edge of a corrugated panel (5, 6) that is inserted into the side supports (3, 3'), so as to define moisture-proof front and rear surfaces to said case, wherein said insertion means further comprises inserting pockets (1, 4) and barbs (1', 4') that are formed internally within the inserting pockets (1, 4), so as to engage with edges of said corrugated panels and wherein further, at least one supporting bar (8, 8') extends partially inwardly from a side support so as to form a space within the case that has a portion which is upwardly open and parallel to the front and rear case surfaces.

2. A case for writing, drawing and hobby tools as defined by claim 1, wherein said insertion means further comprises vertically extending inserting pockets (1, 4) with said barbs (1', 4') therein to engage an edge of a corrugated panel that consists of a single corrugated plastic sheet, wherein said single sheet is bent so as to define the front, bottom and rear surfaces of said case and also bent so as to define said lid (11).

3. A case for writing, drawing and hobby tools as defined by claim 2, wherein said insertion means further comprises barbs (1', 4') that are formed internally within at least one sidewall that defines the inserting pockets (1, 4), so as to engage with vertically extending edge portions of said single corrugated plastic sheet wherein said sheet is bent to extend vertically on said front and rear case surfaces, horizontally therebetween to define a bottom for said case, and further bent horizontally and then vertically from an upper edge of said rear surface so as to define a horizontal top and vertical lid for said case.

4. A case for writing, drawing or hobby tools as defined by claim 3, wherein a pair of supporting bars (8, 8') each extend partially inward from a plastic side support and each further comprises a lower region that is parallel to front and rear case surfaces (5, 6) of the corrugated plastic sheet and a bent upper region so as to form an upwardly open space for insertion of an item that has a portion parallel to the front and rear case surfaces and a staggered configuration in the area of insertion.

5. A case for writing, drawing and hobby tools as defined by claim 1, wherein each of the side supports (3, 3') further have an upper front surface section (13, 13') that is cut-out and shaped to conform with a shape of a side edge of the lid (11).

6. A case for writing, drawing and hobby tools as defined by claim 1, wherein the side supports (3, 3') further comprise indentations (12, 12') upon an external surface.

7. A case for writing, drawing and hobby tools as defined by claim 2, wherein each of the side supports (3, 3') further have an upper front surface section (13, 13') that is cut-out and shaped to conform with a shape of a side edge of the lid (11).

8. A case for writing, drawing and hobby tools as defined by claim 3, wherein each of the side supports (3, 3') further have an upper front surface section (13, 13') that is cut-out and shaped to conform with a shape of a side edge of the lid (11).

9. A case for writing, drawing and hobby tools as defined by claim 2, wherein the side supports (3, 3') further comprise indentations (12, 12') upon an external surface.

10. A case for writing, drawing and hobby tools as defined by claim 3, wherein the side supports (3, 3') further comprise indentations (12, 12') upon an external surface.

11. A case for writing, drawing and hobby tools as defined by claim 4, wherein the side supports (3, 3') further comprise indentations (12, 12') upon an external surface.

* * * * *